US012453407B2

(12) United States Patent
Hofstee et al.

(10) Patent No.: US 12,453,407 B2
(45) Date of Patent: Oct. 28, 2025

(54) BRUSH ASSEMBLY

(71) Applicants: Sander Hendrikus Johannes Hofstee, Wervik (NL); Jan Frederik Doddema, Paterswolde (NL)

(72) Inventors: Sander Hendrikus Johannes Hofstee, Wervik (NL); Jan Frederik Doddema, Paterswolde (NL)

(73) Assignee: MONTI-WERKZEUGE GMBH, Hennef (DE)

( * ) Notice: Subject to any disclaimer, the term of this patent is extended or adjusted under 35 U.S.C. 154(b) by 368 days.

(21) Appl. No.: 18/117,447

(22) Filed: Mar. 5, 2023

(65) Prior Publication Data

US 2023/0276932 A1 Sep. 7, 2023

(51) Int. Cl.

| | |
|---|---|
| ***A46B 13/00*** | (2006.01) |
| ***A46B 15/00*** | (2006.01) |
| ***B24B 29/00*** | (2006.01) |

(52) U.S. Cl.

CPC ..... *A46B 13/003* (2013.01); *A46B 15/0016* (2013.01); *B24B 29/005* (2013.01); *A46B 2200/3093* (2013.01)

(58) Field of Classification Search

CPC ... B24B 29/005; B24B 53/062; A46B 13/003; A46B 15/0016

USPC ..... 15/182, 183, 366, 23, 383

See application file for complete search history.

(56) References Cited

U.S. PATENT DOCUMENTS

| | | | | |
|---|---|---|---|---|
| 2,178,491 | A * | 10/1939 | Palotce | B24D 5/16 451/547 |
| 4,238,870 | A * | 12/1980 | Fahlen | A47L 9/0477 15/389 |
| 9,314,140 | B2 * | 4/2016 | Eriksson | A47L 9/30 |
| 9,554,642 | B2 | 1/2017 | Montabaur | |
| 9,918,544 | B2 * | 3/2018 | Jannaschk | B24B 29/005 |
| 2005/0241085 | A1 * | 11/2005 | Montabaur | A46B 17/00 15/21.1 |
| 2007/0209126 | A1 * | 9/2007 | Montabaur | B24D 13/10 15/23 |
| 2014/0299153 | A1 * | 10/2014 | Jannaschk | A46B 17/06 15/23 |
| 2015/0313431 | A1 * | 11/2015 | Eriksson | A47L 9/0488 15/256.51 |
| 2020/0268139 | A1 * | 8/2020 | Doddema | A46B 9/026 |

* cited by examiner

*Primary Examiner* — Joel D Crandall
(74) *Attorney, Agent, or Firm* — Andrew Wilford

(57) ABSTRACT

A brush assembly has a brush holder rotatable about a rotation axis, a ring brush carried on the holder and having an annular array of radially outwardly projecting bristles, and a stop element fixed adjacent the ring brush, of noncircular section. This stop element extends along and is rotatable about a longitudinal axis generally parallel to the rotation axis and projects into the array of bristles.

7 Claims, 2 Drawing Sheets

BRUSH ASSEMBLY

FIELD OF THE INVENTION

The present invention relates to a brush assembly. More particularly this invention concerns a brush assembly for a power brush.

BACKGROUND OF THE INVENTION

A typical brush assembly for a power brush has a rotatable brush holder and a ring brush having an annular array of outwardly projecting bristles. A stop element engages in the rotating bristle array and serves for increasing the speed at which the bristle tips engage a workpiece surface. Also, the invention relates to a rotary brush tool provided with such a brush assembly and a method of machining a surface of a workpiece using this brush assembly.

In the case of a known and generic brush assembly with the structure described above in accordance with U.S. Pat. No. 9,554,642, the bristles are decelerated for a certain time by means of the stop element engaged in the rotating bristle array. After release of the bristles when passing the stop element, the kinetic energy stored by this action, i.e. via the bristles and/or a brush strip holding the bristles, can be used. The kinetic energy is used for the predominantly hammering on a surface of the workpiece with the ends of the bristles. This achieves comparable effects as is observed in so-called sandblasting. The advantage of the known procedure according to U.S. Pat. No. 9,554,642 with respect to sandblasting is that it works without abrasives such that the technical effort is significantly reduced. Environmental pollution caused by these abrasives can also be avoided. In addition, a particularly cost-effective structure and an efficient approach are observed. This has been proven.

In the further generic prior art according to U.S. Pat. No. 9,918,544, the stop element engaged in the rotating annular array is also formed as an abrasive for the bristles. A distinction can be made between the two functions, i.e. the stopping function and the grinding function, in accordance with a direction of rotation of the ring brush and/or a position in which the stop element is set with respect to the annular array. In fact, for this purpose, the stop element is adjustable with respect to the annular bristle array. The adjustment of the stop element is carried out radially and/or tangentially. An eccentric adjustment of the stop element is also possible. In addition, the stop element can be moved by the driven bristles.

In principle, the prior art has proven itself with regard to surface treating workpiece surfaces with the aid of the bristles and the roughness achieved as a result. However, in the previous approaches, the surface of the workpiece is not uniformly provided with "craters" caused by the bristles. Adjustable roughness levels comparable to sandblasting are also achieved such that a subsequent coating, a welding process, etc. of the relevant surface of the workpiece are possible without any problems occurring. However, the roughness profile is subject to fluctuation, so it has a certain anisotropy in prior art. For many applications, however, an isotropic and uniform roughness of the surface of the treated workpiece is required.

The anisotropy observed in the prior art or lack of uniformity of the roughness profile can be essentially attributed to the fact that the bristles are typically anchored in a brush strip. Since the bristles are often also formed as U-shaped bristles, the brush strip supporting the bristles in its circumferential direction is provided with bristle rows and axial spaces in between due for example to the U-shape of the bristles. These spaces between the individual bristle rows now lead to the fact that the generated roughness profile is unevenly designed during the striking machining of the workpiece surface. In practice, this is countered by the user moving the brush assembly or a rotary brush tool provided with it back and forth over the surface for example.

Apart from the fact that such movement is exhausting and cannot necessarily provide the required uniformity, such procedures cannot be realized and implemented directly in the case of, for example, mechanical processing of the surface of the workpiece using a machine like for example a robot arm. In addition, the prior art requires even more effective machining of the surface of the workpiece. Here, the invention as a whole seeks to remedy the situation.

OBJECTS OF THE INVENTION

It is therefore an object of the present invention to provide an improved brush assembly.

Another object is the provision of such an improved brush assembly that overcomes the above-given disadvantages, in particular that further develops such a brush assembly such that the roughness profile generated by it on the surface of the workpiece being treated has an increased uniformity with respect to previous prior art. At the same time, the possibility of increasing roughness if necessary is to be opened up.

SUMMARY OF THE INVENTION

A brush assembly has according to the invention a brush holder rotatable about a rotation axis, a ring brush carried on the holder and having an annular array of radially outwardly projecting bristles, and a stop element fixed adjacent the ring brush, of noncircular section. This stop element extends along and is rotatable about a longitudinal axis generally parallel to the rotation axis and projects into the array of bristles.

In the context of the invention, therefore, a special stop element engaged in the rotating bristle array is used that has a cross section that deviates from a round or circular cross section. It can for example be angular or polygonal. Thus, while in the prior art, the stop element is predominantly formed as a cylindrical pin, the invention works with a noncylindrical or prismatic stop element with a noncircular cross section. In fact, the stop element for this purpose is usually provided with at least one longitudinal ridge on its outer surface. The cross section of this longitudinal ridge can favorably be triangular.

In connection with the stop element being also rotatable about its longitudinal axis and hence having a drive, this achieves overall that the roughness profile created in this way is clearly uniform with respect to the prior art. As a further special advantage, increased roughness is observed.

In fact, the relevant drive of the stop element can be designed dependent on or independent of the drive of the brush holder with the ring brush.

The first case is where the stop element is rotatably driven by the drive of the brush holder, for example, by the drive of the brush holder via a coupling element and, where applicable, an additional transmission on the stop element in order to rotate it around its longitudinal axis. In general, however, it is done such that the drive of the stop element is independent of the drive of the brush holder with the ring brush. In this case, a separate drive is provided for the stop element.

In most cases, the design is also made such that the stop element rotates oppositely to the ring brush on its outer periphery. It has been proven advantageous when the stop element rotates at the same speed or a higher peripheral speed with respect to the ring brush.

In this way, the stop element initially ensures that with its at least one longitudinal ridge or due to its cross sectionally noncircular design that it not only brakes the individual bristles driving against this when driving the ring brush. Rather, the noncircular design of the stop element or the of triangular cross section longitudinal ridge usually provided at this point ensures in this context that the bristles that come into contact with the longitudinal ridge are also bent back against their drive direction. That is, the bristles are known and basically braked with the aid of the stop element during their rotation, as described in detail in prior art. The noncircular design of the stop element, or the longitudinal ridge now also ensures that the bristle in question bend back beyond this.

As a result, the bent back bristles come into contact with the surface of the workpiece to be machined with an even higher impact energy with respect to those bristles that come into contact with the stop element in an area where there is no longitudinal ridge. In this way, a further intensified machining of the surface of the workpiece is observed than with the prior-art systems. Furthermore, the opposing rotation of the stop element with respect to the ring brush ensures that rotation of the stop element corresponds to different roughness levels.

While the bristles, which are also bent back with the aid of the longitudinal ridge, create particularly deep craters, this does not apply to bristles that do not come into contact with the longitudinal ridge. These different crater depths over the outer surface of the rotating stop element now not only lead to an overall increased roughness of the surface of the workpiece processed in this way with respect to prior art, but also to an additional uniformity of the roughness profile. This can be attributed to the bristles, which are still generally anchored in longitudinal rows in the brush strip, being spaced from each other. However, the different bending stress on the bristles during their rotation leads to the fact that they are partially deflected in a lateral manner and, in this way, no unmachined or little machined areas of the surface of the workpiece are observed. Of course, this is also due to the fact that the bristles are generally only a few millimeters apart from each other and the brush strip usually provides the necessary restoring forces for the bristles as a fabric strip due to its design. In addition, please refer to the explanatory notes in U.S. Pat. No. 9,554,642.

According to a further favorable embodiment, the stop element is not only provided with at least one longitudinal ridge along its outer surface, but a plurality of longitudinal ridges distributed angularly around the outer surface of the stop element are implemented and provided. The longitudinal ridges are equiangularly spaced around the outer surface of the stop element, with uniform angular spacing. In addition, the design is made such that each longitudinal ridge extends longitudinally of the stop element and, with the aid of the stop element or its longitudinal ridge, all bristles of the ring brush are braked or also bent back as described.

An embodiment with special significance is still characterized in that the each longitudinal ridge extends spirally centered on the longitudinal axis of the stop element. The spiral arrangement of the longitudinal ridges with respect to the longitudinal direction or longitudinal axis of the stop element leads to the fact that, in the axial direction, for example, the bristles connected to the brush strip in the same radial extension are not also bent back together by a longitudinal ridge. Rather, only individual bristles are bent back by the stop element in an opposite direction with respect to the ring brush, which leads to a further increased uniformity of the roughness profile of the workpiece surface. This is because the brush strip supporting the bristles is no longer deformed axially by the bristles when the bristles come into contact with the stop element according to the invention, but this deformation is different along the axial direction in question, which leads to a slight additional lateral movement of the bristles and thus to the fact that the distances remaining between the individual bristles are also covered. This means that no untreated or poorly treated areas are observed on the surface of the workpiece and the overall roughness is clearly uniform with respect to prior art.

The opposite rotation of the stop element relative to the ring brush ensures that the bristles that comes into contact with the longitudinal ridge are also bent back. Here, the invention also relies on the fact that the bristles are usually provided with an angled end that comes into contact with the longitudinal ridge or the plurality of longitudinal ridges. The angling of the bristles follows the rotational movement of the ring brush.

As a result, a brush assembly is provided that works with a specially designed stop element that usually rotates in the opposite direction to the ring brush (in the contact area) and due to its noncircular cross section ensures a different deflection of the bristles when coming into contact with the stop element. This varying deflection of the bristles and the associated different kinetic energy not only ensures that the surface of the workpiece is processed with increased roughness, but, in particular, that the roughness profile is homogeneous.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
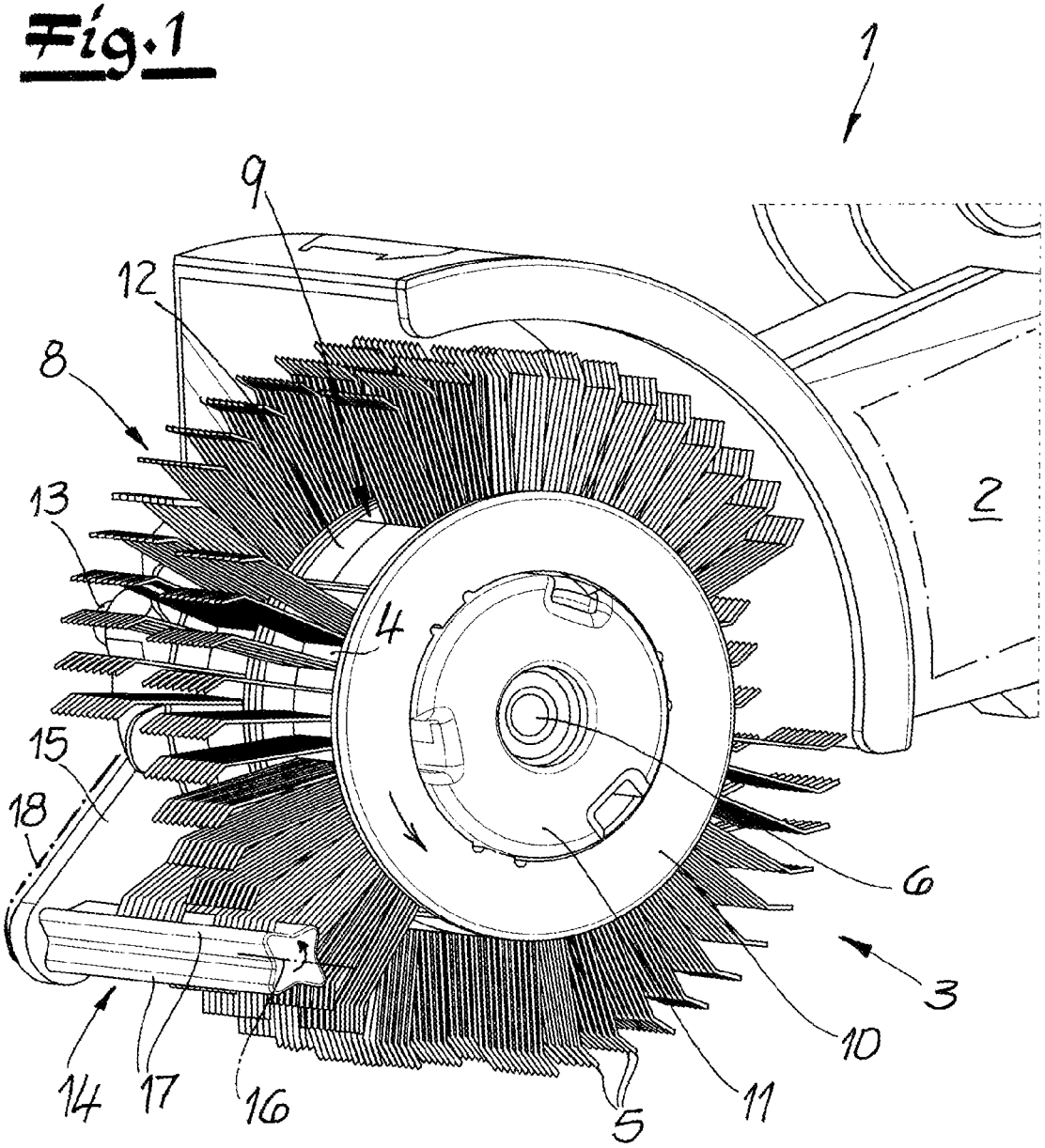
FIG. 1 is a perspective view of an embodiment of a rotary brush tool provided with a brush assembly.
Figure 2:
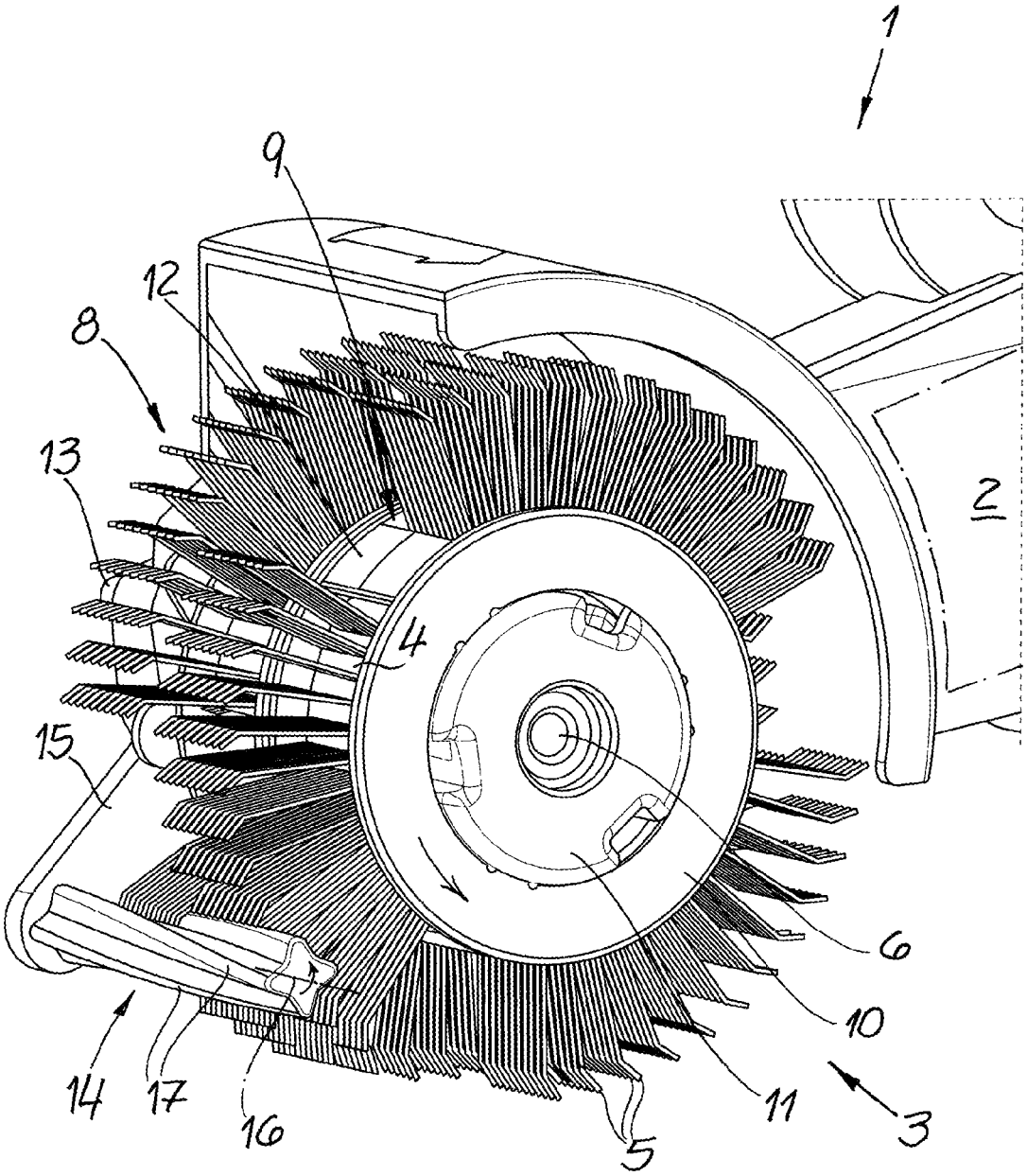
FIG. 2 shows a modified version of the FIG. 1 embodiment.

As seen in FIGS. 1 and 2 a rotary brush tool has a housing 1 and a drive 2 for a brush assembly 3 held therein. In this embodiment but not restricted to this, the brush assembly 3 has a ring brush 4, 5 formed by a brush strip 4 from which bristles extend outward.

Figure 1A:
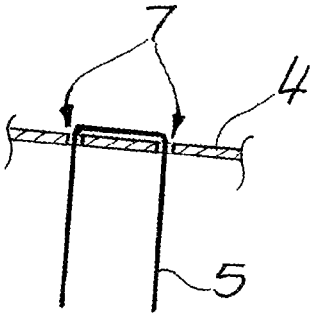
FIG. 1A is a large-scale view of a detail of FIG. 1.

It can be seen that the bristles 5 extend radially with respect to a rotation axis 6 and essentially project outward from a surface of the ring brush 4, 5 or a surface of the brush strip 4. The bristles 5 are U-shaped bristles 5 made of steel and fitted into and extending through mounting holes 7 in the brush strip 4 as shown in FIG. 1A. The bristles 5 form an annular array 8 with gaps 9. The ring brush 4, 5 is rotated by the drive 2 and supported by a brush holder 10, 11. In fact, the brush holder 10, 11 is formed by a ring 10 and a core 11 fitted inside it and carrying the brush strip 4 with the bristles 5. As an example, a brush holder 10, 11 can be used at this point as described in detail in U.S. Pat. No. 9,554,642

FIGS. 1 and 2 show that the brush holder 10, 11 is provided with axial webs 12 that project at the gaps 9 through the ring brush 4, 5 or the brush strip 4. In this way, overall, the brush holder 10, 11 securely rotationally secures the ring brush 4, 5 to a drive shaft 13 of the drive 2 of the rotary brush tool, so that the brush assembly 3 can be rotatably driven according to the embodiment with a counterclockwise movement around the axis 6 as shown in FIGS. 1 and 2.

A stop element 14 engaged in the rotating bristle array 8 is of particular importance. The stop element 14 is a noncylindrical pin 14 carried on an arm 15 of the housing 1 of the rotary brush tool. The stop element or pin 14 is connected parallel to the drive shaft 13 of the drive 2 or parallel to the rotation axis 6 to the arm 15. The length of the stop element 14 is selected such that it essentially corresponds to the width of the brush strip 4, consequently, the stop element 14 does not project axially with completely through the ring brush 4, 5 or only projects from it to an insignificant extent.

According to the invention, the cross section of the stop element 14 is noncircular and it rotates about its longitudinal axis 16. In fact, the cross sectionally noncircular design of the stopping aid or pin 14 in accordance with the illustrated embodiment is realized and implemented such that the stop element 14 is provided with at least one longitudinal ridge 17 on its outer surface. In this embodiment, it can be seen that a plurality of the longitudinal ridges 17 are distributed angularly around the outer surface of the stop element 14. The longitudinal ridges 17 are generally angularly equispaced over the outer surface of the stop element 14.

It can be seen that the cross section of each respective longitudinal ridge 17 is triangular. In addition, the design in the context of the embodiment according to FIG. 1 is made so that each longitudinal ridge 17 extends at this point longitudinally of the stop element 14 and consequently along the longitudinal axis 16. On the other hand, in the embodiment according to FIG. 2, the design is such that the longitudinal ridges 17 extend spirally with respect to the longitudinal direction of the stop element 14 and consequently its longitudinal axis 16. In both cases, four longitudinal ridges 17 angularly equispaced around the outer surface of the stop element 14, are not used restrictively. This means that the longitudinal ridges 17 are distributed at 90° intervals on the outer surface of the stop element or pin 14.

As already explained, the stop element 14 is rotatable in the context of the invention around its longitudinal axis 16. For this purpose, the stop element 14 has a drive shown schematically at 18 in FIG. 1. The design can be made such that the stop element 14 is driven via the drive 18 or the drive 2 inside the housing 1, and that, according to the invention, in an angular direction of rotation opposing the direction of rotation of the ring brush 4, 5. This applies explicitly to the contact area of the bristles 5 with the stop element 14. According to the embodiment, this amounts to the fact that both the ring brush 4, 5 and the stop element 14 both rotate counterclockwise. However, since the ring brush 4, 5 comes into contact with the outer surface of the stop element 14 at the ends of the bristles 5 and both rotate counterclockwise, an opposite rotation on the outer periphery. As a result, the individual bristles 5 are not only slowed down when coming into contact with the stop element 14 as in prior art, but experience an additional bending by the also provided longitudinal ridges 17. Hence, contrary to the rotation of the ring brush 4 so that the bristles 5 coming into contact with the respective longitudinal ridges 17 hit with an increased kinetic energy on a surface of a workpiece to be machined, as has already been explained above.

The drive 18 can be designed depending on the drive or the drive 2 of the brush holder 10, 11 with the ring brush 4, 5. In this case, the drive impetus of the stop element 14 is derived from that of the drive 2. For this purpose, the drive 2 may work via, for example, a toothed belt or like transmission element in the appropriate sense on the stop element 14. In general, however, the drive 18 of the stop element 14 is designed independently of the drive or the drive 2 of the brush holder 10, 11. Either way, the stop element 14 rotatably driven around its longitudinal axis 16. The peripheral speed of the stop element 14 is generally equal to or higher than the peripheral speed of the ring brush 4, 5. In this way, the surface (not expressly shown) of the workpiece (not shown) is not only provided with an increased roughness with respect to prior art, but also a uniform surface treatment is achieved. This is where the main advantages can be seen.

We claim:

1. A brush assembly comprising:

a brush holder rotatable about a rotation axis;

a ring brush carried on the holder and having an annular array of radially outwardly projecting bristles; and a stop element fixed adjacent the ring brush, extending along and rotatable about a longitudinal axis generally parallel to the rotation axis, provided with a plurality of longitudinally extending ridges of triangular section spaced angularly around its outer surface, and projecting into the array of bristles.

2. The brush assembly according to claim 1, further comprising:

a drive for rotating the stop element about the longitudinal axis.

3. The brush assembly according to claim 2, wherein the drive rotates the brush oppositely to the holder.

4. The brush assembly according to claim 2, wherein the drive rotates the stop at a peripheral speed at least equal to a peripheral speed of the brush holder.

5. The brush assembly according to claim 2, wherein the drive is coupled to a drive of the brush holder.

6. The brush assembly according to claim 1, wherein the ridges extend parallel to the longitudinal axis of the stop element.

7. The brush assembly according to claim 1, wherein the longitudinal ridges extend as spirals centered on the longitudinal axis on the outer surface of the stop element.

* * * * *